United States Patent [19]

Matsuda et al.

[11] Patent Number: 4,534,133

[45] Date of Patent: Aug. 13, 1985

[54] MACHINE FOR SUPERFINISHING ANNULAR WORKPIECES

[75] Inventors: Teruo Matsuda; Kizo Kawaguchi, both of Osaka, Japan

[73] Assignee: Osaka Seiki Kabushiki Kaisha, Ikeda, Japan

[21] Appl. No.: 560,404

[22] Filed: Dec. 12, 1983

[30] Foreign Application Priority Data

Dec. 22, 1982 [JP] Japan ..... 57-233000

[51] Int. Cl.[3] ..... B24B 9/00

[52] U.S. Cl. ..... 51/58; 51/348; 51/166 MH

[58] Field of Search ..... 51/58, 291, 166 TS, 51/166 T, 348, 67, 166 MH

[56] References Cited

U.S. PATENT DOCUMENTS

| | | | |
|---|---|---|---|
| 174,808 | 3/1876 | Gann | 51/348 |
| 2,141,491 | 12/1938 | Searles | 51/348 |
| 2,350,527 | 6/1944 | Peden | 51/347 |
| 2,634,561 | 4/1953 | Wayne | 51/58 |
| 3,339,312 | 9/1967 | Hannon | 51/58 |
| 3,503,154 | 3/1970 | Schmidt | 51/58 |
| 4,136,488 | 1/1979 | Wander | 51/58 |

*Primary Examiner*—Harold D. Whitehead

*Attorney, Agent, or Firm*—Wenderoth, Lind & Ponack

[57] ABSTRACT

A machine for superfinishing the inner race surface of annular workpieces such as bearings with two honing stones of different grain sizes held by a common holder arm. Structure is provided for reciprocally arcuately moving the holder arm perpendicularly of the plane of rotation of the workpiece. Structure is also provided for moving the holder arm in a direction generally perpendicular to the axis of rotation of the workpiece toward and away from the inner race surface. A lever mounted on the holding arm is selectively engageable with either of the two honing stones pressing the selected honing stone toward and against the inner race surface. Structure is also provided for moving the holder arm back and forth in the direction of juxtaposition of the two honing stones a distance equal to the pitch of the two honing stones so as to alternatively position one or the other of the two honing stones for being pressed against the inner race surface by the lever, whereby the inner race surface is smoothed by one or the other of the honing stones by reciprocally moving the holder arm.

6 Claims, 8 Drawing Figures

MACHINE FOR SUPERFINISHING ANNULAR WORKPIECES

BACKGROUND OF THE INVENTION

1. Field of the Invention

The present invention relates to a machine for superfinishing annular workpieces such as bearings and particularly to a machine for superfinishing the inner race surface of annular workpieces.

2. Description of the Prior Art

There is a growing demand for higher accuracy of the inner race surface of annular articles, particularly bearings, and to meet this demand the bearing industry prepares two machines, a rough-finishing machine equipped with a rough honing stone and a fine-finishing machine equipped with a fine honing stone, so that upon completion of rough finishing of an annular workpiece by the rough honing stone, the workpiece is transferred for change of mounting. In this arrangement, however, two machines are required for finishing the inner race surface of annular workpieces and the change of mounting of workpieces results in deviation and misalignment, thereby degrading the finishing accuracy. Particulary in the case of finishing by the fine honing stone, an accuracy on the order of a 1/100000 mm is required, so that deviation and misalignment have a serious effect on finishing accuracy.

For superfinishing the outer surface of annular workpieces, the applicants have invented a superfinishing machine which alternatively applies any one of a plurality of honing stones to the outer surface, as is disclosed in applicant's copending U.S. patent application Ser. No. 416,707, filed Sept. 10, 1982 and now U.S. Pat. No. 4,485,592, dated Dec. 4, 1984. However, no such device is available for superfinishing the inner race surface of annular workpieces.

OBJECTS AND SUMMARY OF THE INVENTION

An object of the present invention is to provide a useful superfinishing machine for finishing the inner race surface of annular workpieces, which is capable of performing both rough finishing and superfinishing without transfer of the workpieces from one machine to another.

To accomplish this object, the present invention provides a machine for holding two honing stones of different grain sizes on a common holder arm, and selectively pressing the two honing stones against the inner race surface of an annular workpiece by a novel means.

The honing stones are held by the holder arm within the plane of the workpiece adjacent to the inner race surface of the workpiece. A structure is provided for reciprocally arcuately moving the holder arm generally perpendicular to the plane of the workpiece, an inner sleeve for moving the holder arm generally perpendicular to the spindle axis of the rotating workpiece, a lever mounted on the holder arm which is selectively engagable with either of the two honing stones for pressing the selected honing stones toward and against the inner race surface, and structure for moving the holder arm back and forth in the direction juxtaposition of the two honing stones a distance equal to the pitch of the two honing stones so as to alternatively position one or the other of the two honing stones for being pressed against the inner race surface by the lever, whereby the inner race surface is smoothed by one or the other of the honing stones by reciprocally moving the holder arm.

BRIEF DESCRIPTION OF THE DRAWINGS

These and other features and object of the invention will be best understood from the following detailed description of the preferred embodiment taken with the accompanying drawings in which.

DETAILED DESCRIPTION OF THE PREFERRED EMBODIMENTS

Figure 1:
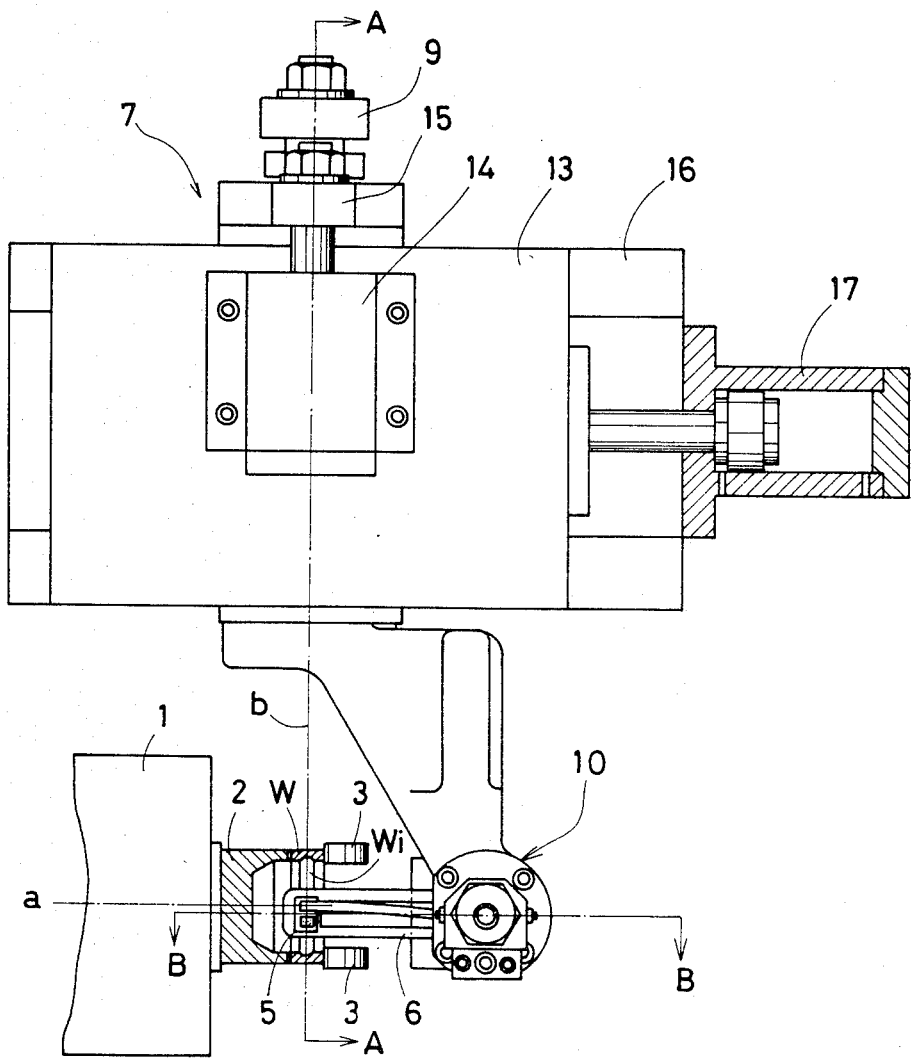
FIG. 1 is a complete plan view of a superfinishing machine for an annular workpiece in accordance with one embodiment of the present invention.
Figure 2:
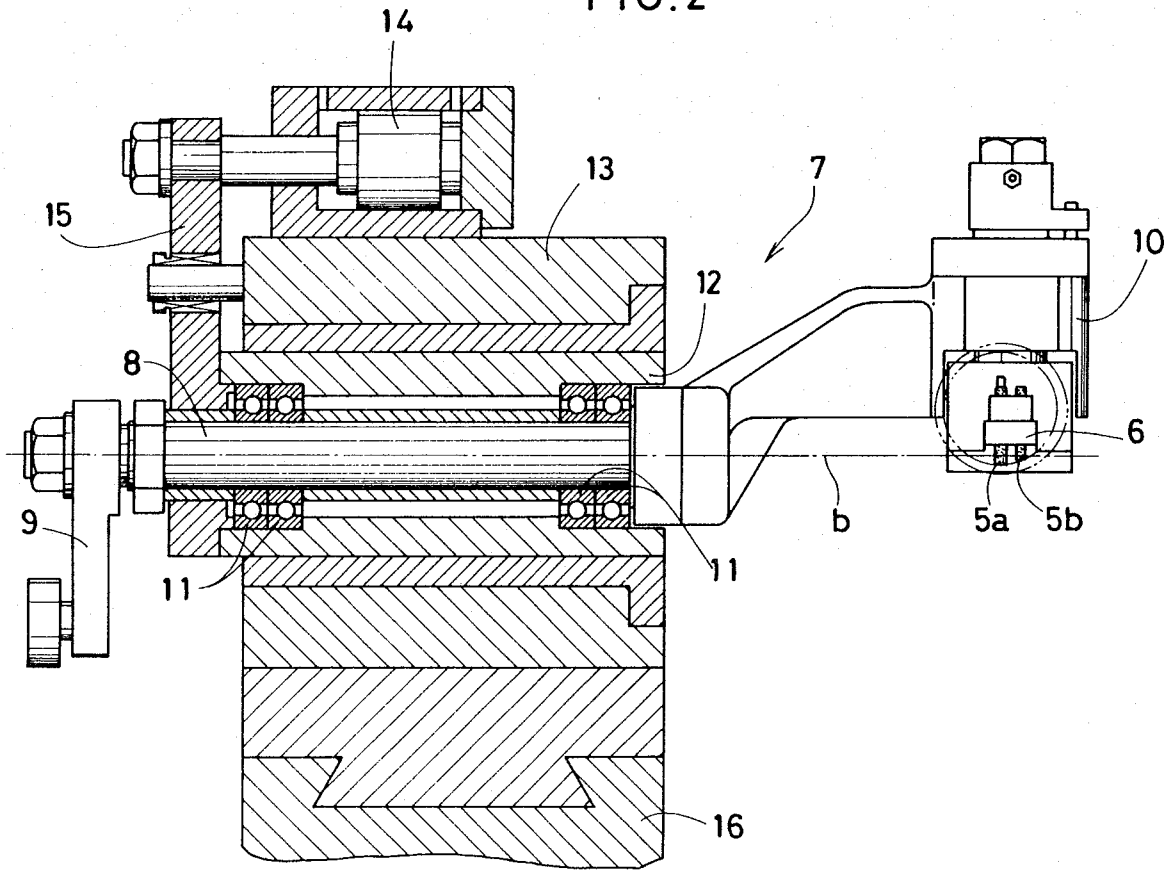
FIG. 2 is a sectional view taken along the line A—A in FIG. 1.

FIG. 1 is a plan view of a machine for superfinishing annular workpieces, according to an embodiment of the present invention, and FIG. 2 is a view taken in the direction of arrows A—A in FIG. 1.

Figure 5A:
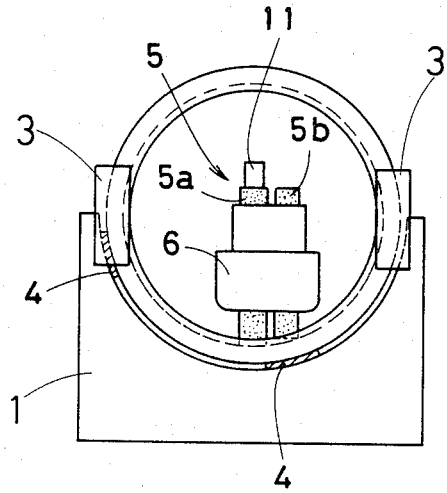
FIGS. 5A and 5B show states before and after shifting of the honing stones.
Figure 5B:
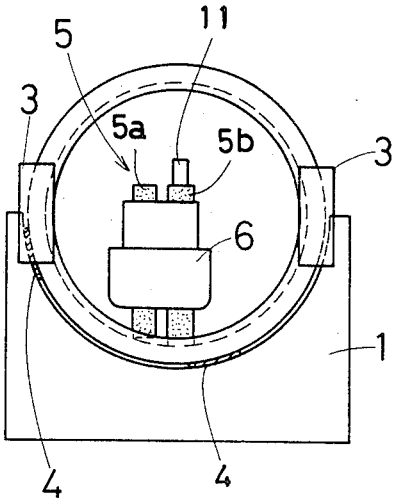
Figure 6A:
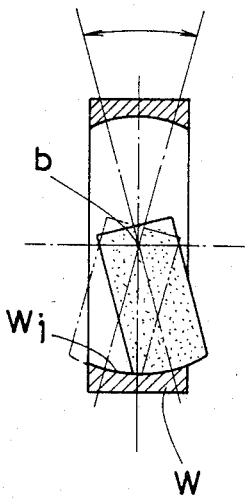
FIGS. 6A and 6B show states in which the inner race surface of an annular workpiece is finished.
Figure 6B:
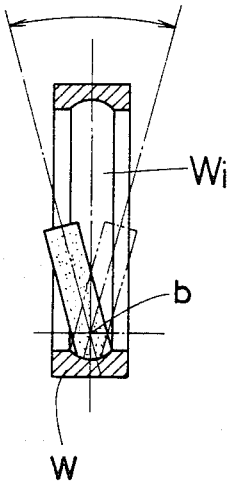

In the figures, the numeral 1 denotes a driving unit having a backing plate 2 attached to the front end of a spindle. An annular workpiece W is pressed against the backing plate 2 by pressure rollers 3 and, as shown in FIGS. 5(A) and 5(B), it is supported around its periphery by shoes 4 and in this condition it is rotated around a spindle axis a. Two honing stones 5, including honing stones 5*a* and 5*b* of different grain sizes, contact the inner race surface Wi of said annular workpiece W. A holder arm 6 holds honing stones 5*a* and 5*b*, and a honing stone oscillating means such as honing stone oscillating unit 7, oscillates the honing stones around an oscillating axis b which perpendicularly intersects spindle axis a. This honing stone oscillating unit, as shown in the sectional view in FIG. 2, comprises an oscillating shaft 8, an oscillating arm 9 connected to one end of said oscillating shaft 8 for oscillating the latter, and a honing stone holder support unit 10 installed at the other end of oscillating unit 7 causes the honing stones 5 to oscillate around the oscillating axis b, as shown in FIGS. 6(A), 6(B) whereby the inner race surface Wi of the annular workpiece W is superfinished to an arcuately curved surface. The annular workpiece W whose inner race surface Wi assumes an arcuately curved surface is used as an outer ring for ball bearings. However, the machine of the present invention is applicable to superfinishing of outer rings not only for ball bearings but also for slide ball bearings, conical roller bearings, and self-centering roller bearings. In those cases, the oscillating shaft 8 of the oscillating unit 7 may be replaced by a swing mechanism which executes simple harmonic motion in the direction of the spindle axis a or in a direction which forms a predetermined angle with the spindle axis a.

The aforesaid oscillating shaft 8 is supported in a sheath 12 through bearings 11, said sheath 12 being slidably held in a sliding block 13. The sheath 12 is connected through a connecting rod 15 to a honing stone shifting cylinder 14 mounted on the upper surface of the sliding block 13. The honing stone shifting cylinder 14 has a stroke such that it is moved by an amount corresponding to the pitch with which the two honing stones 5*a* and 5*b* are juxtaposed on the holder arm 6: thus, by driving this cylinder 14, it is possible to slide the whole of the oscillating unit 7 supported in the sheath 12 to thereby move the honing stones 5*a* and 5*b* held on the holder arm 6 in the direction of juxtaposition by an amount corresponding to the pitch of juxtaposition. FIGS. 5(A) and 5(B) show the positions of the honing stones 5*a* and 5*b* before and after this movement. The sliding block 13 is mounted on a stationary block 16 by being dovetailed to the latter and is slidable by a predetermined amount in a direction parallel to the spindle axis a by means of an index cylinder 17. Such movement of the sliding block 13 is necessary when the annular workpiece W is to be removed from the driving unit 1 upon completion of superfinishing.

Figure 3:
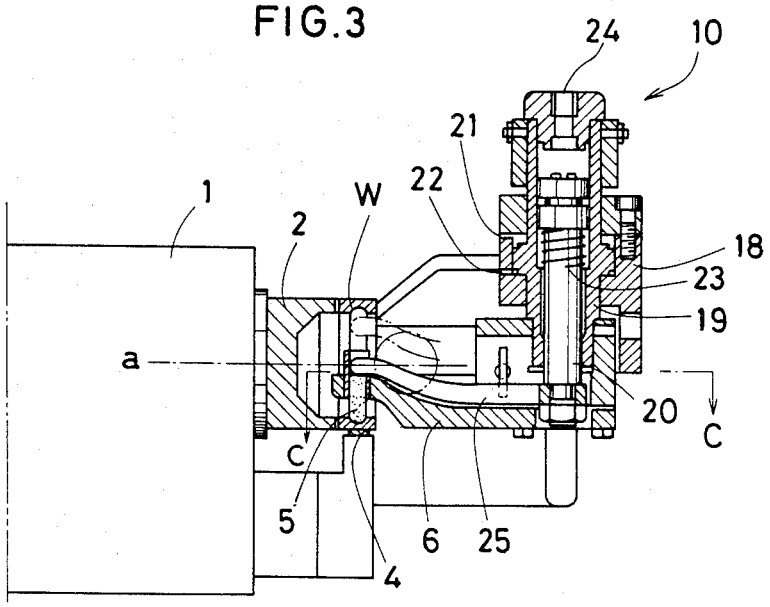
FIG. 3 is a sectional view taken along the line B—B in FIG. 1.

The aforesaid honing stone support unit 10, as shown in FIG. 3, comprises a support unit outer sleeve 18, an inner sleeve 19 received in said outer sleeve 18, and a piston body 20 received in said inner sleeve 19. The inner sleeve 19 is vertically movable with respect to the outer sleeve 18 by injection of air or pressure oil through ports 21 and 22, while the piston body 20 is upwardly urged by a spring 23 and is downwardly movable by injection of air or the like through a port 24 in the upper end of inner sleeve 19. Thus, the base end of the holder arm 6 is connected to said inner sleeve 19, and by injecting and discharging air or the like through the ports 21 and 22, the honing stone 5 can be moved upwardly and downwardly with respect to the honing stone oscillating unit 7. On the other hand, the piston body 20 has a honing stone pressing lever 25 connected thereto, so that downward movement of the piston body 20 causes the lever 25 to press the honing stone 5*a* or 5*b* against the inner race surface Wi of the annular workpiece W.

Figure 4:
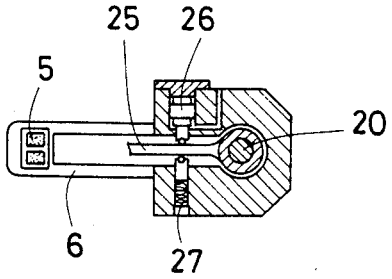
FIG. 4 is a sectional view taken along the line C—C in FIG. 3.

The lever 25, as shown in FIG. 4, is laterally held between a lever turning piston 26 installed in the lateral wall of the inner sleeve 19 and a spring 27, so that as the turning piston 26 moves forwardly and backwardly, the lever 25 is turned around the piston body 20. The amount of turning movement is determined so that the front end of the lever 25 is moved by an amount corresponding to the pitch of juxtaposition of the honing stones 5*a* and 5*b*. Therefore, with this turning movement it is possible for the lever 25 to selectively press the two honing stones 5*a* and 5*b*.

According to the aforesaid arrangement, superfinishing of the annular workpiece W can be performed in the following sequence.

(a) The annular workpiece W is mounted on the driving unit 1.

(b) The index cylinder 17 is driven to advance the block 13 to insert the honing stones 5 into the annular workpiece W.

(c) Air or the like is injected into the port 21 to lower the holder arm 6. This brings the honing stone 5*a* into contact with the inner race surface Wi of the annular workpiece W.

(d) Air or the like is injected into the port 24 to lower the honing stone pressing lever 25 to press the rough finishing honing stone 5*a*.

(e) Upon completion of the above procedure, rough finishing is started.

(f) Upon completion of rough finishing, the air or the like is discharged through the port 24 to allow the lever 25 to move upwardly under the restoring force of the spring 23.

(g) Air or the like is injected into the port 22 to raise the holder arm 6. This separates the honing stones 5*a* and 5*b* from the inner race surface Wi of the annular workpiece W.

(h) The honing stone shifting cylinder 14 is driven to move the honing stones 5 in the direction of juxtaposition by an amount corresponding to the pitch of juxtaposition.

(i) The lever turning piston 26 is driven to turn the honing stone pressing lever 25 to the right.

(j) The operations described in (c) and (d) are performed and superfinishing is started.

(k) Upon completion of superfinishing, the operation described in (f) and (g) are performed to return the honing stone shifting cylinder 14 and also return the block 13 so as to discharge the annular workpiece W. The cycle then goes back to the operation (a) to perform superfinishing of the next workpiece.

Thus, the present invention has the following effects: since, in superfinishing an annular workpiece, honing stones of different grain sizes can be automatically selectively used on the same station, a single finishing machine is sufficient and there is no need for change of mounting of the annular workpiece in shifting from rough finishing to superfinishing, so that finishing of superfine class can be performed without loss of time.

What is claimed is:

1. A machine for superfinishing the inner race surface of an annular workpiece rotating in a plane about a center spindle axis, said machine comprising:

a holder arm for holding two honing stones of different grain size in juxtaposed positions within the plane of rotation of the workpiece adjacent the inner race surface of the workpiece;

first means for reciprocally arcuately moving said holder arm in a first direction generally perpendicular to the plane of rotation of the workpiece;

second means for moving said holder arm in a second direction generally perpendicular to said spindle axis toward and away from the inner race surface;

a lever mounted on said holder arm selectively engagable with either of said two honing stones for pressing the selected honing stone in said second direction toward and against the inner race surface;

means for selectively positioning said lever adjacent said selected stone; and means for adjusting the relative positions of said holder arm and the workpiece in the direction of juxtaposition of the two honing stones a distance equal to the pitch of the two honing stones such that one or the other of the two honing stones is alternately positioned for being pressed against the inner race surface by said lever, whereby said inner race surface is smoothed by the one or the other of the two honing stones by reciprocally moving said holder arm by said first means.

2. A machine as in claim 1, wherein the direction of juxtaposition is perpendicular to said second direction and to said spindle axis, said adjusting means comprising means for moving said holder arm back and forth in the direction of juxtaposition of the two honing stones a distance equal to the pitch of the two honing stones.

3. A machine as in claim 1, wherein said first means comprises means for oscillating said holder arm about an axis perpendicularly intersecting said spindle axis.

4. A machine as in claim 1, wherein said first means comprises means for vibrating said holder arm in the direction of said spindle axis.

5. A machine as in claim 1, wherein said first means comprises means for vibrating said holder arm in a direction forming a predetermined angle with said spindle axis.

6. A machine as in claim 2, wherein said first means comprises a holder support unit reciprocally arcuately moveable in said first direction, said holder support unit including an outer sleeve, an inner sleeve reciprocally slidable in said outer sleeve in said second direction, said holder arm being mounted to said inner sleeve for movement therewith, a piston body slidably mounted in said inner sleeve for movement in said second direction, said lever being connected to said piston body so as to press the selected honing stone when said piston is moved in said second direction, and means mounted to said holder arm for pivoting said lever about said piston body so as to engage said lever with the selected one of said two honing stones.

* * * * *